US005079394A

United States Patent [19]

Torma et al.

[11] Patent Number: 5,079,394

[45] Date of Patent: Jan. 7, 1992

[54] SNAP ACTION SWITCH AND CONTACT THEREFOR

[75] Inventors: Mikael Torma, Olten; Hansjörg Portmann, Gerlafingen, both of Switzerland

[73] Assignee: Elektro-Apparatebau Olten AG, Olten, Switzerland

[21] Appl. No.: 530,612

[22] Filed: May 30, 1990

[30] Foreign Application Priority Data

Jun. 30, 1989 [CH] Switzerland ..... 2442/89

[51] Int. Cl.[5] ..... H01H 5/20; H01H 5/18

[52] U.S. Cl. ..... 200/407; 200/406; 200/460

[58] Field of Search ..... 200/406, 407, 408, 409, 200/459, 460, 461, 447, 449, 454, 456, 402, 453

[56] References Cited

U.S. PATENT DOCUMENTS

| | | | |
|---|---|---|---|
| 3,994,483 | 11/1976 | Perucchi et al. | 200/408 |
| 4,385,218 | 5/1983 | Nishida | 200/406 |
| 4,484,042 | 11/1984 | Matsui | 200/406 |
| 4,590,342 | 5/1986 | Schlegel | 200/314 |

*Primary Examiner*—Henry J. Recla
*Assistant Examiner*—David J. Walczak
*Attorney, Agent, or Firm*—Peter K. Kontler

[57] ABSTRACT

The switching unit of a snap action electric switch employs a contact of the type called mainplate and having a circumferentially complete frame with a substantially diametrically extending blade. The frame has two lugs which flank the median portion of the blade and can be affixed to or simply abut the bottom wall of a cupped mounting member which further receives a pusher capable of moving the median portion of the mainplate from a first end position, at a distance from the bottom wall of the mounting member, toward and through a dead-center position whereupon the median portion snaps to a second end position in which it engages a contact at the bottom wall of the mounting member. The end portions of the blade merge tangentially into the adjacent concavoconvex sections of the frame. The useful life of the mainplate is longer than that of a conventional mainplate wherein four corner portions of the frame are affixed to the bottom wall of the mounting member. In addition, the touch of median portion of the blade is more satisfactory, all because only two portions of the frame, namely the two lugs which flank the median portion of the blade, are in abutment with or are actually affixed to the bottom wall of the mounting member.

21 Claims, 3 Drawing Sheets

SNAP ACTION SWITCH AND CONTACT THEREFOR

CROSS-REFERENCE TO RELATED CASES

The snap action switch of the present invention can utilize a housing of the type disclosed in commonly owned copending patent application Ser. No. 07/530,653 filed Jun. 30, 1990 for "Electric switch" and in commonly owned copending patent application Ser. No. 07/530,654 filed Jun. 30, 1990 for "Housing for electric switches".

BACKGROUND OF THE INVENTION

The invention relates to electric switches in general, and more particularly to improvements in snap action switches. Still more particularly, the invention relates to improvements in snap action switches with switching units wherein the contact (also called mainplate) which must be caused to move from a first end position toward and through a dead-center position in order to be capable of snapping to a second end position has a deformable blade within a frame which is or which can be affixed to a mounting member of the switching unit.

As a rule, the mainplate of the switching unit in a snap action switch has a substantially rectangular frame and a center member or blade which is parallel with the longer sections (first outside members) and has end portions integral with the shorter sections (second outside members)of the frame. The central portion of each longer section of the frame is provided with a V-shaped or omega-shaped corrugation which entails a reduction of the length of such sections and causes a corresponding deformation (bulging) of the blade. The four corners of the frame are provided with bent-over extensions which are anchored in the bottom wall of the mounting member in the switching unit. This ensures that the four corners of the frame remain in positions of abutment with the adjacent side of the bottom wall irrespective of the extent of deformation of the blade. In other words, the mainplate is installed in stressed condition in order to ensure that the median portion of the blade will invariably tend to assume a predetermined (first) end position in which it is normally remote from a contact to be engaged by the median portion of the blade in order to complete an electric circuit. Two of the aforementioned extensions (normally at two diagonally opposite corners of the frame) are sufficiently long to project through and beyond the bottom wall of the mounting member and to serve as terminals which are connected to conductor means. When the median portion of the blade is caused to assume its second end position, it engages the aforementioned contact whereby the conductive mainplate completes a circuit by enabling electric current to flow from the two longer extensions, through the frame and through the blade and on to the contact which is engaged by the median portion of the blade. The contact for the median portion of the blade can be a flat or slightly arched piece of conductive metallic material, and a portion of this contact also extends through the bottom wall to be connected with a conductor.

The deformation of the blade in the first end position of its median portion is normally such that a concave side of the blade faces toward the contact on the bottom wall of the mounting member. The first end position of the median portion of the blade is a stable position, i.e., the median portion tends to assume and to thereupon remain in the first end position. The means for moving the median portion of the blade from its first end position comprises an actuator which is movable relative to the mounting member in order to force the median portion toward the aligned contact on the bottom wall of the mounting member. The second end position of the median portion of the blade is preferably an unstable position, i.e., the median portion remains in the second end position only as long as it is acted upon by a force which suffices to prevent it from reassuming the first end position due to its innate resiliency and due to stressing of the frame of the mainplate.

The just discussed mainplate and the switching unit which employs such mainplate exhibit two serious drawbacks. First of all, each movement of median portion of the blade to its second end position necessitates very pronounced stressing of the entire mainplate so that the mainplate, and especially its frame, is likely to break after a relatively small number of actuations of the switching unit. The reason for such pronounced stressing of the frame is that all four corners of the frame are anchored in the mounting member of the switching unit, i.e., the frame cannot yield during movement of the median portion of the blade from its first end position toward and beyond the dead-center position. Attempts to overcome such drawbacks of conventional mainplates include anchoring of two of four extensions of the frame with a certain amount of play relative to the mounting member; however, this offers very little relief as far as the stressing of the frame is concerned. Secondly, the switching characteristics and the so-called touch of a switching unit which employs a mainplate wherein all four corners of the frame are anchored in the mounting member are far from satisfactory. Thus, the magnitude of the force which is needed to move the median portion of the blade from its first end position varies very little so that the operator in charge of effecting actuation of the switching unit cannot readily discern that stage when the median portion of the blade moves through the dead-center position. In addition, it is necessary to exert a rather pronounced force in order to maintain the median portion of the blade in the (unstable) second end position, i.e., in that end position in which the median portion of the blade remains only as long as it is acted upon by a substantial external force.

OBJECTS OF THE INVENTION

An object of the invention is to provide a novel and improved mainplate or contact for use in the switching units of snap action switches and to construct the mainplate in such a way that its life expectancy is much more satisfactory than that of conventional mainplates.

Another object of the invention is to provide a mainplate which is constructed and which can be mounted in such a way that the operator of the switching unit employing the mainplate can readily ascertain changes in the position of the blade with reference to the frame.

A further object of the invention is to provide a mainplate which exhibits a superior touch and superior switching characteristics.

An additional object of the invention is to provide a mainplate wherein the median portion of the blade must be subjected to a rather pronounced force only while it is close to and while it moves through its dead-center position.

Still another object of the invention is to provide a novel and improved frame and a novel and improved blade to serve as component parts of the above outlined mainplate.

A further object of the invention is to provide a novel and improved switching unit which employs the above outlined mainplate and to provide a novel and improved method of installing the mainplate in the switching unit.

Another object of the invention is to provide a snap action electric switch which embodies the above outlined switching unit and mainplate.

Still another object of the invention is to provide the switching unit with novel and improved means for deforming the blade of the mainplate.

An additional object of the invention is to provide a switching unit wherein the frame of the mainplate need not be affixed to or anchored in the mounting member at all, or is affixed to the mounting member at no more than two optimum locations, to thus prolong the useful life of the mainplate.

A further object of the invention is to provide a novel and improved combination of signal generating means and mainplate deforming means for use in the above outlined switching unit.

SUMMARY OF THE INVENTION

One feature of the present invention resides in the provision of a contact or mainplate for use in a snap action switch. The improved mainplate includes a circumferentially complete frame (e.g., a metallic frame having a substantially rectangular, square, oval or circular outline) and an elongated resilient blade which is located within the frame. The blade has a median portion and two end portions which are integral with the frame, and the frame has two bearing portions (e.g., in the form of two coplanar lugs, particularly lugs which resemble or constitute eyelets) which are located at opposite sides of the median portion of the blade in a predetermined plane and serve to abut a mounting member of the switch. The arrangement is such that the blade normally maintains its median portion in a first end position at a first distance from the predetermined plane and that such median portion is movable toward the plane (in response to the application of a force thereto) from the first end position toward and beyond a dead-center position to thereupon snap to a second end position at a second distance (e.g., zero distance) from the predetermined plane.

In accordance with one presently preferred embodiment, the frame resembles a rectangle or a square and has two first sections which flank the blade and each of which is provided with one of the bearing portions, and two second sections each of which is integral with one end portion of the blade and which alternate with the first sections. The second sections can (but need not) be shorter than the first sections.

At least those sections of the frame which are integral with the end portions of the blade can assume a concavo-convex shape with the convex sides facing the predetermined plane. The median portion of the blade can be substantially flat or only slightly concavo-convex when the blade is free to assume the first end position. Alternatively, the median portion of the blade (or the entire blade) can exhibit a pronounced concavo-convex shape (with the concave side facing the predetermined plane) in the first end position of the blade. It is presently preferred that the end portions of the blade merge substantially tangentially into the adjacent sections of the frame.

The configuration of the frame and/or of the blade is or can be selected in such a way that the median portion of the blade is maintained at least close to its first end position (in the absence of application of the aforementioned force) even if the integrity of the blade is destroyed, e.g., when the blade is severed or breaks as a result of frequent movements of its median portion between the two end positions.

The frame is or can be provided with corrugations which flank each of its bearing portions. The bearing portions preferably constitute projections which are integral parts of the frame and extend away from the respective sides of the median portion of the blade. As mentioned above, each such projection can constitute a flat eyelet.

The frame can include rounded portions which flank the end portions of the blade. Of course, the entire frame is rounded if it has a substantially circular or oval outline.

The width of the blade need not be constant; it is presently preferred to configurate the blade in such a way that the width of its median portion exceeds the width of at least one of the end portions.

Another feature of the invention resides in the provision of a switching unit which can be used in a snap action switch and employs the above outlined mainplate. The switching unit comprises a cupped mounting member which is made of an electrically insulating material and has a bottom wall and a sidewall extending from one side of the bottom wall. The switching unit further comprises a mainplate which is installed in the cupped mounting member and includes the aforementioned circumferentially complete frame and the aforementioned resilient blade within the frame. The blade has a median portion and two end portions which are integral with the frame, and the frame has two bearing portions located at opposite sides of the median portion of the blade adjacent the one side of the bottom wall. The switching unit further comprises electric conductor means provided on or at the bottom wall and connected with the bearing portions of the frame, and an electric contact at the one side of the bottom wall. The blade normally maintains its median portion in the aforementioned first end position at a distance from the contact at the one side of the bottom wall, and the median portion of the blade is movable toward the bottom wall (in response to the application of a force to the median portion) from the first end position toward and beyond the dead-center position to thereupon snap to the second end position in which it engages the contact.

The switching unit further comprises means for applying the aforementioned force, and such force applying means can include a pusher which is preferably surrounded by the sidewall of the mounting member and is movable toward and away from the mainplate (the movement away from the mainplate, and more particularly away from the frame of the mainplate and from the bottom wall, is induced by the resilient blade which tends to maintains its median portion in the first end position). The pusher abuts the median portion of the blade, and the switching unit preferably further comprises means for limiting the extent of movability of the pusher away from the bottom wall.

The pusher can comprise at least one motion receiving portion which extends in a direction away from the bottom wall of the mounting member which latter is installed in a switch housing further confining actuating means which serves to move the pusher by way of the at least one motion receiving portion in a direction toward the bottom wall to thereby effect a movement of median portion of the blade away from the first end position. The pusher can include a plate which is reciprocable in the mounting member toward and away from the bottom wall, and the at least one motion receiving portion can include a protuberance which is provided on and can be integral with the plate of the pusher.

The switching unit can further comprise an electric signal generator (e.g., one or more light emitting diodes) which is provided on the pusher and has electric terminals extending through passages provided therefor in the mounting member. The signal generator can be mounted at that side of the plate forming part of the pusher which faces away from the mainplate in the cupped mounting member.

The conductor means can includes current-conducting strips which are embedded in the bottom wall of and extend outwardly from the mounting member.

The contact can also comprise one or more strip-shaped conductors which are embedded in the bottom wall and extend outwardly from the mounting member.

The bearing portions of the frame can be fixedly secured (e.g., soldered or welded) to the conductor means.

The novel features which are considered as characteristic of the invention are set forth in particular in the appended claims. The improved switch itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
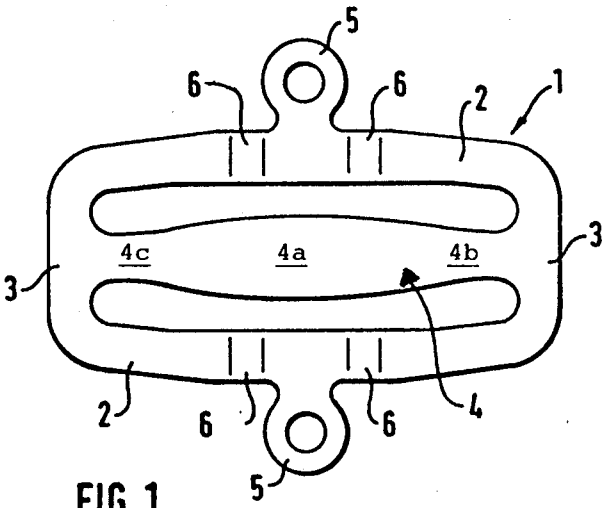
FIG. 1 is a plan view of a contact or mainplate which embodies one form of the invention.
Figure 2:
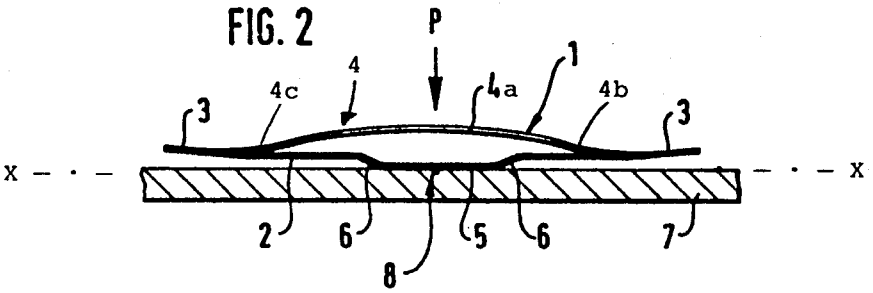
FIG. 2 is a side elevational view of the mainplate and further showing the bottom wall of a mounting member for the bearing portions of a frame forming part of the mainplate.

FIGS. 1 and 2 show a contact or mainplate 1 which embodies one form of the invention. The mainplate 1 is a one-piece stamping which is made of resilient metallic sheet material. This mainplate comprises a substantially rectangular frame having two elongated first sections (first outside members) 2 flanking an elongated center member or blade 4, and two shorter second sections (second outside members) 3 which are integral with the adjacent end portions **4*b*, 4*c* of the blade. The latter further includes a median portion 4*a* having a width exceeding that of the end portions 4*b* and 4*c*. The sections 2 are integral with bearing portions or lugs 5 in the form of flat eyelets which are disposed at opposite sides of the median portion 4*a* and extend away from the blade 4. Each of the two lugs 5 is flanked by two corrugations 6 of the respective section 2. Those portions of the sections 2, 3 which flank the end portions 4*b*, 4*c* of the blade 4 are rounded. As can be seen in FIG. 2, the common plane X—X of the lugs 5 is normally spaced apart from the median portion 4*a* of the blade 4, and the entire mainplate 1 is designed in such a way that the median portion 4*a* normally assumes the first end position of FIG. 2, namely an end position at a predetermined distance from the common plane X—X of the lugs 5. If the median portion 4*a* is acted upon by a force P, it moves toward and beyond a dead-center position to thereupon snap over and to assume a second end position at a different second distance (e.g., zero distance) from the plane X—X of the lugs 5. The configuration of the mainplate 1 is preferably such that the forces developing as a result of depression of the median portion 4*a* from the first end position of FIG. 2 toward the plane X—X of FIG. 2 are kept within narrow limits, not only as concerns their magnitude but also as concerns their direction. Such forces are transmitted from the end portions 4*b*, 4*c* into the respective sections 3** of the frame.

The purpose of the relatively wide median portion **4*a* is to reinforce the respective part of the blade 4. It is equally possible to reinforce the median portion 4*a* by increasing its thickness relative to the thickness of the end portion 4*b* and/or 4*c*** and/or by increasing its thickness as well as its width.

The lugs 5 abut, as at 8, the adjacent side of a wall 7 corresponding to the bottom wall 13 of a substantially cup-shaped mounting member 12 which is shown in FIGS. 5 to 10 and forms part of a switching unit 11 utilizing the mainplate 1 of FIGS. 1 and 2. If desired or necessary, the lugs 5 can be permanently or separably connected to the wall 7 by rivets, by soldering or in any other suitable way. At least one of the lugs 5 preferably further serves as a terminal which is connectable to a conductor of the switching unit 11 employing the mainplate 1.

The corrugations 6 are designed to maintain the sections 3 of the frame of the mainplate 1 at a distance from the adjacent side of the wall 7, i.e., from the plane X—X of the lugs 5. Each of these corrugations includes a first rounded portion immediately adjacent the respective lug 5 and a second rounded portion at a greater distance from the plane X—X. FIG. 2 further shows that the corrugations 6 impart to the sections 2, 3 a concavo-convex shape with the convex surfaces or sides facing the wall 7 and the plane X—X. The blade 4 (in the first end position of the median portion **4*a***) also exhibits a concavo-convex shape but its orientation is such that its rather pronounced concave side faces the plane X—X and the wall 7. The just described configuration of the corrugations 6, of the remaining portions of the sections 2, of the sections 3 and of the blade 4 can be imparted as a result of predominantly plastic deformation such as stamping, rolling, pressing, deep drawing, injection molding or die casting. It is preferred to design and configurate the improved mainplate 1 in such a way that the amount of internal stressing in the inoperative position (i.e., with the median portion 4*a* of the blade 4 in the first end position of FIG. 2) is minimal or negligible.

As can be seen in FIG. 2, wherein the median portion 4*a* of the blade 4 assumes its first end position, the end portions 4*b*, 4*c* of the blade merge substantially tangentially into the adjacent portions of the frame, i.e., into the respective sections 3. The major portions of the sections 2, 3 and all portions of the blade 4 are then spaced apart from the plane X—X, the concave side of the blade 4 faces the wall 7, and the convex sides of the sections 3 also face the wall 7. The major portions of the sections 2 of the mainplate 1 which is shown in FIG. 2 are located in a plane which is substantially parallel to the plane X—X. The end portions of the sections 2 are slightly bent in a direction away from the respective lugs 5, away from the wall 7 and toward the regions where they merge into the respective ends of the sections 3.

Figure 3:
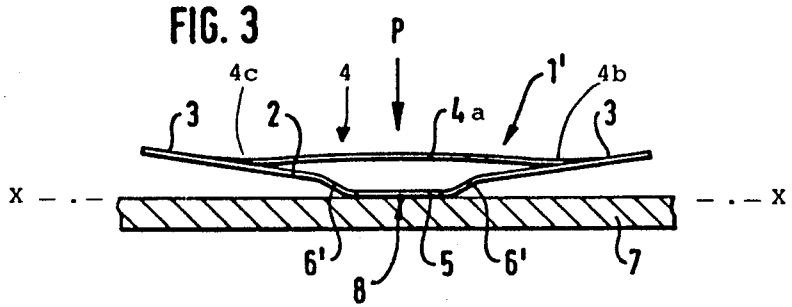
FIG. 3 is a similar side elevational view of a modified mainplate.

FIG. 3 shows a modified mainplate 1′ which, in a plan view (as shown in FIG. 1), is or can be identical with the mainplate 1 of FIGS. 1 and 2. The difference between the mainplates 1 and 1′ is that the major portions of sections 2, 3 of the frame forming part of the mainplate 1′ are more distant from the plane X—X when the median portion 4*a* of the blade 4 is free to assume the illustrated first end position. Moreover, the blade 4 of FIG. 3 is substantially flat or only slightly concavo-convex with the concave side facing the plane X—X and the wall 7. The end portions 4*b*, 4*c* merge substantially tangentially into the respective frame sections 3, the same as in the frame of the mainplate 1 of FIGS. 1 and 2. The corrugations of sections 2 forming part of the frame in the mainplate 1′ of FIG. 3 are denoted by reference characters 6′. The plane X—X of the lugs 5 can coincide with the plane of the upper side of the wall 7 and is or can be at least substantially parallel to the plane of the unstressed blade 4. The curvature of sections 2 and 3 in the frame of the mainplate 1′ is less pronounced than the curvature of such sections in the frame of the mainplate 1 of FIGS. 1 and 2.

Tangential merger of the end portions 4*b*, 4*c* of the blade 4 into the respective sections 3 of the frame in the mainplate 1 or 1′ is desirable and advantageous because this reduces the likelihood of development of pronounced peak stresses during deformation of the blade 4, i.e., during movement of the median portion 4*a* toward or away from the plane X—X, as well as in the dead-center position and each end position of the median portion 4*a*. Rounding of the corners between the alternating longer and shorter sections 2, 3 of each of the two frames also contributes to a lowering of peak stresses during movement of the median portion 4*a* of the blade 4 toward or away from the wall 7.

When the median portion 4*a* of the blade 4 is acted upon by a force P (substantially at right angles to the plane X—X) in order to move the median portion toward and beyond the dead-center position, the application of such force entails elastic deformation of all sections (2, 3) of the respective frame while the median portion 4*a* advances toward the aforementioned dead-center position prior to snapping over to the second end position in which it abuts a suitable contact (see the contact 19 in FIGS. 8 and 9) to thereby complete and/or otherwise influence one or more electric circuits. The arrangement is preferably such that the second end position of the median portion 4*a* is an unstable or labile position, i.e., the median portion 4*a* tends to leave the second end position and to move back to the illustrated first end position at a greater distance from the plane X—X (this holds true for the two illustrated embodiments of the mainplate). The aforementioned contact can be fixedly installed at the upper side of the wall 7 or it can be embedded therein between the lugs 5, i.e., in the path of movement of the median portion 4*a* toward and beyond its dead-center position. The contact is connected with one or more conductors which can be embedded in or which can overlie the insulating wall 7. When the circuit including the contact between the lugs 5 is completed, the mainplate 1 or 1′ conducts electric current between such contact and the conductor or conductors which are connected to the one and/or the other lug 5. The circuit remains completed as long as the applied force P suffices to maintain the median portion 4*a* of the blade 4 in the second end position, i.e., in a position of abutment with the afore-mentioned contact. The circuit is opened in a fully automatic way as soon as the force P is weakened or the application of such force is terminated so that the median portion 4*a* immediately returns to the first end position of FIGS. 2 or 3, depending upon whether the switching unit employs the mainplate 1 or 1′.

An important advantage of the improved mainplate is that it need not be fixedly secured to a mounting member (such as the member including the wall 7 of FIGS. 2 and 3) at more than two points. In fact, the improved mainplate need not be affixed to the wall 7 at all, or it suffices to connect the one and/or the other lug 5 while the frame portions which include the remaining parts of the sections 2 and the entire sections 3 remain unattached to the mounting member. This ensures that mechanical stressing of each and every section or of each and every portion of each section of the frame is but a minute fraction of mechanical stressing of sections in frames which are used in the aforediscussed and other conventional mainplates wherein all four corners of a generally rectangular frame must be affixed to the mounting member. The reason is that all or nearly all portions of each section of the frame of the mainplate 1 or 1′ can yield in any one of three directions, namely in a direction toward or away from the plane X—X, in a direction at right angles to the plane of FIG. 2 or 3, and in a direction which is parallel to the plane of FIG. 2 or 3.

Another important advantage of the improved mainplate 1 or 1′ is that its so-called switching characteristics and its touch are superior to those of conventional mainplates. This will be described with reference to the diagram of FIG. 4 wherein the applied force P is measured (e.g., in kilograms) along the ordinate and the length L (distance of travel of median portion 4*a* of the blade 4) is measured (e.g., in centimeters) along the abscissa.

Figure 4:
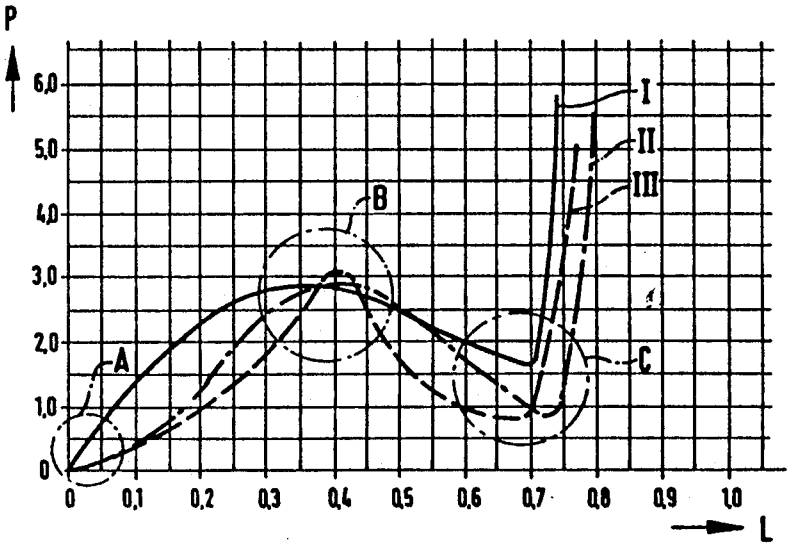
FIG. 4 is a diagram wherein the curves denote forces which must be applied against the blade of a conventional mainplate and against the blades of the mainplates which are shown in FIGS. 1-2 and in FIG. 3.

The curve I of FIG. 4 denotes the variations of force P as a function of the distance L in a conventional mainplate wherein all four corners of a generally rectangular or square frame are riveted or otherwise affixed to a mounting member. The curve II denotes the ratio of P to L when using the mainplate 1 of FIGS. 1 and 2, and the curve III denotes the ratio of P to L when using the mainplate 1' of FIG. 3.

When the median portion of the blade in a conventional mainplate leaves its first end position (at A in the diagram of FIG. 4), the applied force P must rise substantially gradually while the median portion of the blade moves toward the dead-center position (as at B in FIG. 4). That portion of the curve I which extends from A to B is rather steep during the initial stage and thereupon flattens as the median portion of the blade in the conventional mainplate approaches the dead-center position at B. The magnitude of the force P thereupon decreases only slightly while the median portion of the blade moves toward the second end position (as at C in FIG. 4).

The first portion of the curve II (as seen from A to B in FIG. 4) is not as steep as the corresponding portion of the curve I but the curve II thereupon slopes upwardly rather steeply as the median portion 4*a* of the blade 4 in the mainplate 1 of FIGS. 1 and 2 approaches the dead-center position. The curve II thereupon slopes gradually downwardly while the median portion 4*a* moves toward the second end position (at C in FIG. 4). The force P which is required to maintain the median portion 4*a* of the blade 4 of the mainplate 1 in the second end position is much smaller than the force which must be applied to maintain the median portion of the blade in a conventional mainplate in the second end position (note the curve I at C in FIG. 4). The force P which is being applied to the median portion 4*a* of the blade 4 in the mainplate 1 during movement of the median portion toward and through the dead-center position (at B in FIG. 4) matches or approximates the force which must be applied to move the median portion of the blade in a conventional mainplate through the dead-center position. The touch of a blade having a median portion which must be acted upon by a force P as indicated by the curve II of FIG. 4 has been found to be much more acceptable to an operator than the touch of a blade which must be acted upon by a force P in a manner as indicated by the curve I of FIG. 4. The force which is required to hold the median portion 4*a* of the blade 4 in the mainplate 1 of FIGS. 1–2 in the second end position is approximately one-half the force which must be applied in order to hold the median portion of the blade in a conventional mainplate in the second end position.

The characteristics of the mainplate 1' of FIG. 3, as denoted by the curve III of FIG. 4, are even more satisfactory than those of the mainplate 1 of FIGS. 1 and 2. Thus, the curve III exhibits a pronounced peak at B (i.e., during movement of median portion 4*a* of the blade 4 of FIG. 3 through the dead-center position), and the magnitude of the force P decreases even more satisfactorily as soon as the median portion 4*a* advances beyond the dead-center position on its way toward the second end position (at C in the diagram of FIG. 4). The pronounced peak at B is desirable and advantageous, the same as the rather pronounced reduction of force P during movement of the median portion 4*a* of the blade 4 of the mainplate 1' from the dead-center position (B) toward the second end position (C).

The mainplate 1 or 1' can be modified in a number of ways without departing from the spirit of the invention. For example, the frame of the mainplate 1' can assume a square, other polygonal, circular or oval outline. Furthermore, the corrugations 6 or 6' can be omitted if the lugs 5 are configurated in a manner to maintain the frame of the mainplate 1 or 1' at an optimum distance from the wall 7 and from the plane X—X. Irrespective of the selected configuration of the mainplate 1 or 1', it is desirable to design the mainplate in such a way that the positions of the blade 4 and frame 2+3 relative to each other are achieved by appropriate plastic deformation of all portions of the mainplate. For example, the mainplate can be made of spring steel or from another springy current-conducting material.

Figure 7:
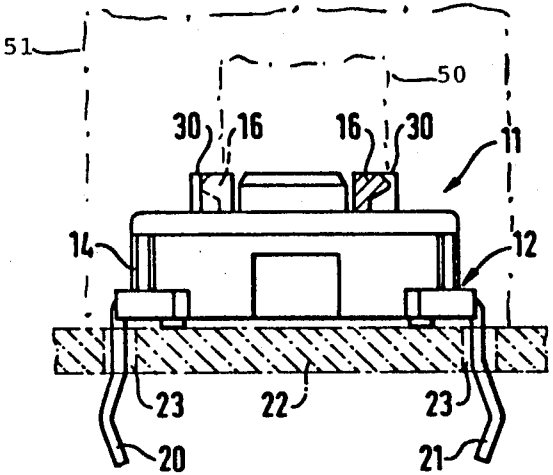
FIG. 7 is a side elevational view of the switching unit and further showing a circuit board which supports the switching unit.
Figure 6:
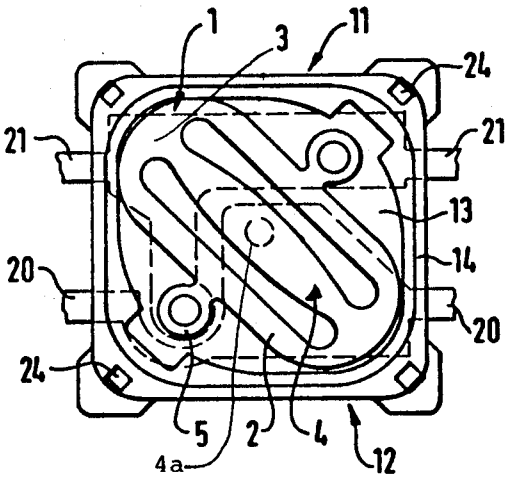
FIG. 6 is a plan view of the mounting member and of the mainplate in the switching unit of FIG. 5.
Figure 8:
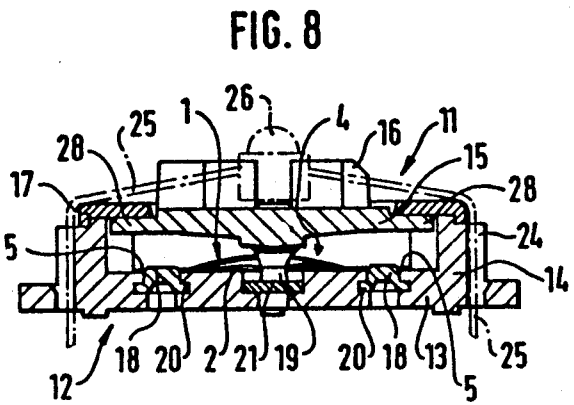
FIG. 8 is a sectional view as seen in the direction of arrows from the line VIII—VIII in FIG. 5, a signal generator on the plate-like pusher of the switching unit being indicated by phantom lines.

FIGS. 5 to 8 show a first embodiment of a switching unit 11 which can employ the mainplate 1 or 1' of FIGS. 1–2 or FIG. 3, and FIGS. 9–10 show a second embodiment which differs from the first embodiment only in that it utilizes a slightly different signal generator. The switching unit 11 comprises the aforementioned substantially cup-shaped mounting member 12 having a bottom wall 13 which performs the function of the bottom wall 7 in FIG. 2 or 3, and a sidewall 14 which extends from one side of the bottom wall 13. That side of the bottom wall 13 from which the sidewall 14 extends serves as a support for the mainplate (FIGS. 6 and 8 show a mainplate 1 which is similar to but not exactly identical with the mainplate of FIGS. 1 and 2 because the sections 3 shown in FIG. 6 are more rounded than the sections 3 which are shown in FIG. 1). The force applying means (i.e., the means for moving the median portion 4*a* of the blade 4 of the mainplate 1 in the mounting member 12 from the first end position toward the second end position of engagement with the contact 19) includes a plate-like pusher 15 which is reciprocable within the confines of the sidewall 14 toward and away from the bottom wall 13. That side of the pusher 15 which faces away from the bottom wall 13 and mainplate 1 has a set of motion receiving projections 16 which can be engaged by a part of actuating means for the switching unit. The actuating means can include an elastic foil (not shown), a radiation transmitting panel (not shown) and a reciprocable reflector 50, all toward or away from the bottom wall 13. Reference may be had to the aforementioned commonly owned copending patent applications Ser. Nos. 07/530,653 and 07/530,654 which fully describe and show the details of a suitable housing and the details of suitable actuating means for the switching unit 11. The latter can be installed in a recess in the rear section of a preferably composite housing the front section of which accommodates the aforementioned foil, panel and reflector of the actuating means.

The switching unit 11 further comprises a device 17 which limits the extent of movability of the pusher 15 in a direction away from the bottom wall 13 of the mounting member 12. The device 17 comprises a frame which is affixed to the sidewall 14 and overlies certain portions of the pusher 15 while affording access to the motion receiving protuberances 16 of the pusher.

Figure 5:
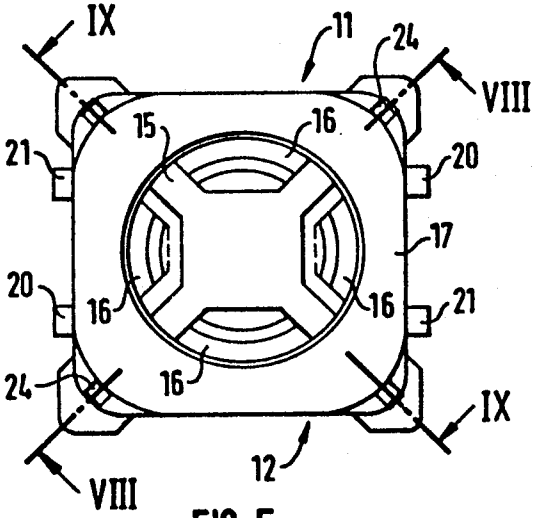
FIG. 5 is a plan view of one embodiment of a switching unit which employs a mainplate of the type shown in FIGS. 1-2 or in FIG. 3.

The means for fixedly securing the lugs 5 of the frame of the mainplate 1 to the bottom wall 13 includes two rivet-shaped securing elements 18 which are anchored in the bottom wall 13 and are connected with strip-shaped conductors 20 embedded in the bottom wall 13 and extending outwardly from the mounting member 12 (see FIGS. 5 and 6).

Figure 10:
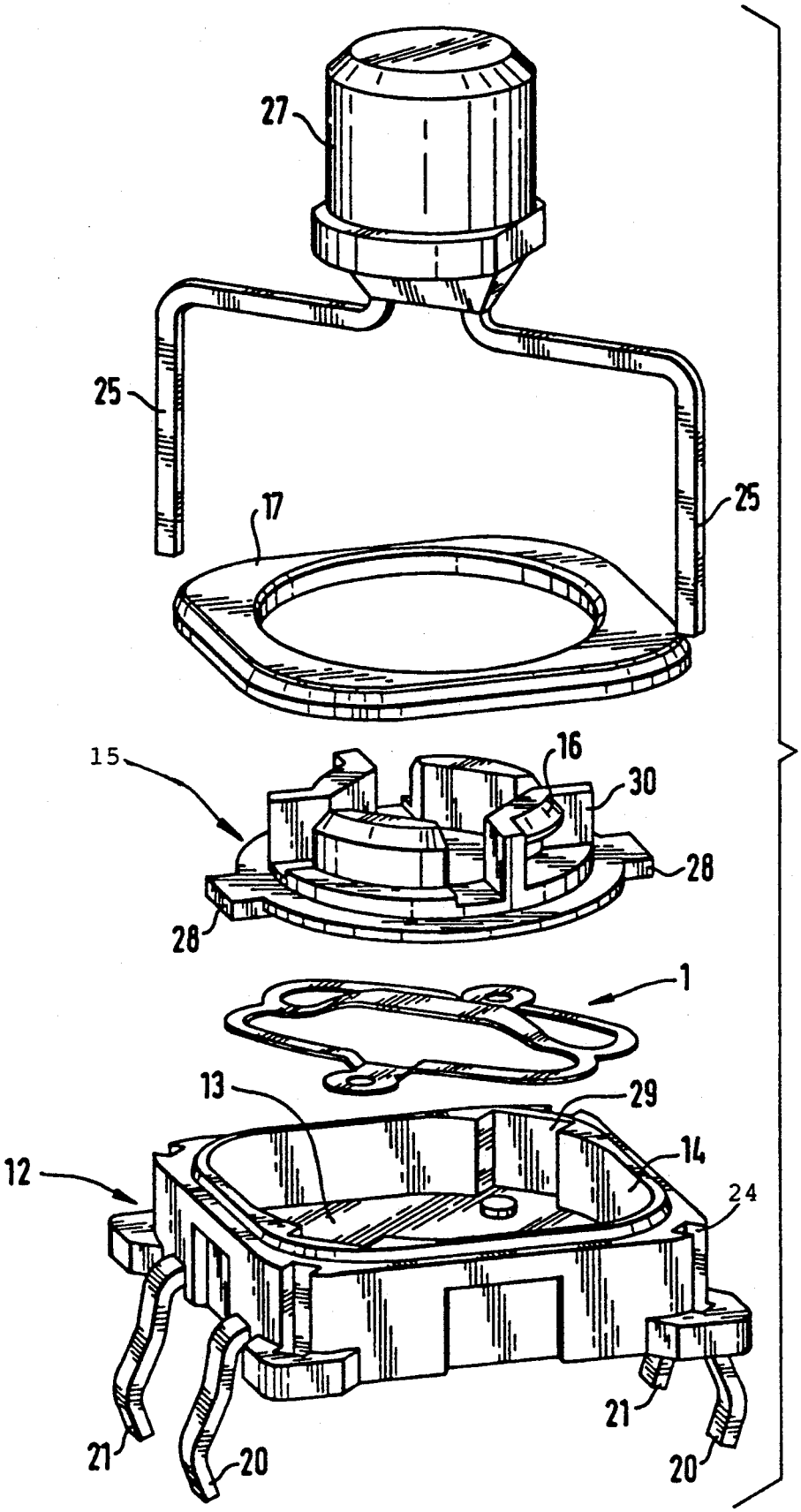
FIG. 10 is an exploded perspective view of the switching unit which is shown in FIG. 9.

The substantially button- or knob-like contact 19 is secured to the bottom wall 13 between the sections 2 of the mainplate 1 to be located in the path of movement of the median portion 4*a* of the blade 4 and to be engaged by such median portion when the latter reaches its unstable second end position. The contact 19 is connected with or includes at least one strip-shaped conductor 21 which is also embedded in the bottom wall 13 and extends outwardly from the mounting member 12. As shown in FIGS. 7 and 10, the exposed portions of the strip-shaped conductors 20, 21 can be bent through approximately 90° so that they extend substantially at right angles to the plane of the bottom wall 13 and can be introduced into suitable passages of a circuit board 22. The purpose of the circuit board 22 is fully described in the aforementioned copending patent applications Ser. Nos. 07/530,653 and 07/530,654; i.e., such circuit board can carry two or more switching units 11 and the housings 51 for the switching units can be designed to constitute distancing elements which maintain the circuit board 22 at an optimum distance from and in parallelism with a plate-like support for two or more snap action switches. The circuit board 22 has holes or bores or otherwise configurated passages 23 for the exposed portions of the conductors 20 and 21.

The illustrated mounting member 12 has a substantially square outline and each of its four corners is or can be provided with a passage or channel 24 which extends substantially at right angles to the bottom wall 13 and serves to receive portions of terminals 25 forming part of a signal generator 26 (e.g., a signal generator employing one or more light emitting diodes) which is or can be affixed to and is located at the outer side of the pusher 15, i.e., at that side which faces away from the bottom wall 13 and mainplate 1. The signal generator 26 (indicated in FIG. 8 by phantom lines) employs only two terminals 25 so that two of the four passages 24 in the mounting member 12 remain empty. The signal generator 26 is nested between the annulus of motion receiving protuberances 16 on the pusher 15.

Figure 9:
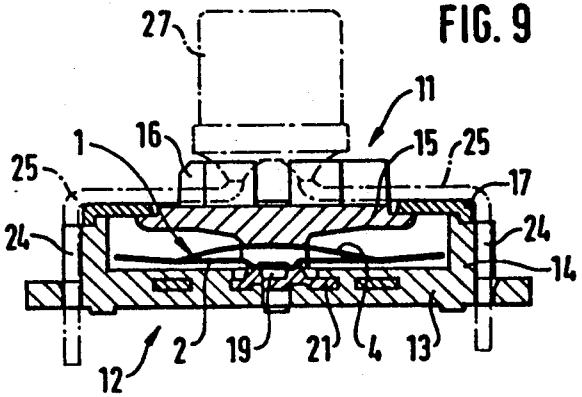
FIG. 9 is a sectional view as seen in the direction of arrows from the line IX—IX of FIG. 5, a modified signal generator being indicated by phantom lines.

The embodiment of FIGS. 9 and 10 differs from the switching unit 11 of FIGS. 5 to 8 in that it employs a differently configurated and larger signal generator 27 which is again installed at the exposed side of the pusher 15 so that it affords access to the motion receiving protuberances 16. In all other respects, the switching unit 11 of FIGS. 9–10 is or can be identical with the switching unit 11 of FIGS. 5 to 8. The terminals 25 of the signal generator 26 or 27 are connected to selected conductors of the circuit board 22 when the switching unit 11 is properly secured to the circuit board and is ready to be introduced into the aforementioned recess in the rear section of the housing 51.

FIG. 10 shows that the pusher 15 is provided with two radially outwardly extending followers 28 which are disposed diametrically opposite each other and extend into complementary grooves 29 in the internal surface of the sidewall 14 to ensure predictable movements of the pusher 15 toward and away from the bottom wall 13. The motion receiving protuberances 16 of the pusher 15 are provided with radially extending centering ribs 30 for the reflector 50 in the housing 51.

An advantage of the improved switching unit 11 is its simplicity. Moreover, the switching unit 11 is compact and ensures predictable movements of median portion 4*a* of the blade 4 in the properly inserted mainplate 1 toward and away from engagement with the contact 19. The pusher 15 can be depressed against the resistance of the resilient blade 4 by the aforementioned composite actuating means or by simpler (e.g., one-piece) actuating means; all that is necessary is to provide actuating means which can displace the pusher 15 relative to the mounting member 12 in order to move the median portion 4*a* of the blade from its first end position.

Another advantage of the improved switching unit 11 is that it can be assembled within a shorter period of time than a conventional switching unit because the mainplate 1 or 1' need not be positively secured to the bottom wall 13 or is secured to such bottom wall at not more than two points (lugs 5). The entire mainplate 1 or 1' can undergo deformation in response to movement of the median portion 4*a* of the blade 4 from its first end position so that not a single portion of the mainplate must be subjected to a very pronounced stress which would be likely to result in breakage of the blade 4 and/or frame. The improved mainplate is preferably designed in such a way that the position of the blade 4 with reference to the frame does not change even if the blade happens to break, i.e., if the integrity of the blade is destroyed in actual use of the switching unit 11. It has been found that the total number of repeated actuations of the switching unit 11 is much higher than the total number of repeated actuations of a conventional switching unit before the mainplate 1 or 1' of the improved switching unit breaks. The rather pronounced increase of the force P which must be applied to move the median portion 4*a* of the blade 1 in the improved mainplate 1 or 1' through the dead-center position (at B in FIG. 4) is desirable because it improved the touch of the actuating means for the pusher 15. As a rule, the operator prefers a touch of the type denoted by the curve II or III of FIG. 4 over the touch of a conventional switching unit (as denoted by the curve I in FIG. 4).

A further important advantage of the switching unit 11 is that its mode of operation is determined as soon as the unit is assembled, i.e., the characteristics of the switching unit 11 cannot be influenced (especially adversely influenced) by the housing 51. This is due to the fact that the component (mainplate 1 or 1') which determines the switching characteristics and the touch of the unit 11 is installed in the mounting member 11 before the latter is introduced into the housing 51 and/or on the circuit board 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A mainplate for use in a snap action switch, comprising a circumferentially contiguous frame having an opening with and elongated resilient blade located therein said blade having a median portion and opposite end portions connected to spaced apart portions of said frame, said frame having two bearing portions located at opposite sides of said median portion in a predetermined plane and arranged to abut a mounting member of the switch, said end portions of said blade and said spaced apart portions of said frame defining convex surfaces confronting said plane, said blade normally maintaining said median portion in a first end position at a first distance from said plane which is at least equal to the distance from said mounting member to where said blade connects with said frame and said median portion being movable toward said plane, in response to the application of a force thereto, from the first end position toward and beyond a dead-center position lying at a plane passing through the points of connection between said blade and frame to thereupon snap to a second end position at a second distance from said plane.

2. The mainplate of claim 1, wherein said frame further includes two second sections which flank said blade and each of which is provided with one of said bearing portions, each of said first named sections being integral with one of said end portions and said first named sections alternating with said second sections.

3. The mainplate of claim 1, wherein said median portion is substantially flat in the first end position thereof.

4. The mainplate of claim 1, wherein said median portion has a concave surface confronting said plane in the first position of said median portion.

5. The mainplate of claim 1, wherein said end portions merge substantially tangentially into the respective sections of said frame.

6. The mainplate of claim 1, wherein said frame and said blade are configurated to maintain said median portion at least close to said first end position, in the absence of application of said force, even in the event of breakage of said blade.

7. The mainplate of claim 1, wherein said frame has corrugations flanking each of said bearing portions.

8. The mainplate of claim 7, wherein said bearing portions constitute projections forming integral parts of said frame and extending away from the respective sides of said median portion.

9. The mainplate of claim 8, wherein each of said projections includes a flat eyelet.

10. The mainplate of claim 1, wherein said frame has rounded portions flanking the end portions of said blade.

11. The mainplate of claim 1, wherein said median portion has a first width and at least one of said end portions has a lesser second width.

12. A switching unit for use in a snap action switch, comprising a cupped mounting member having a bottom wall and a sidewall extending from one side of said bottom wall; a mainplate provided in said mounting member and including a circumferentially contiguous frame having an opening with an elongated resilient blade located therein, said blade having a median portion and opposite end portions connected to spaced apart portions of said frame, said frame having two bearing portions located at opposite sides of said median portion adjacent said one side of said bottom wall and said end portions of said blade and spaced apart portions of said frame defining convex sides confronting said one side of said bottom wall; electric conductor means provided on said bottom wall and connected with said bearing portions; and an electric contact at said one side of said bottom wall, said blade normally maintaining said median portion thereof in a first end position at a distance from said contact which is at least equal to the distance from said bottom wall to where said blade connects with said frame and said median portion being movable toward said bottom wall, in response to the application of a force thereto, from said first end position toward and beyond a dead-center position lying at a plane passing through the points of connection between said blade and frame to thereupon snap to a second end position of engagement with said contact.

13. The switching unit of claim 12, further comprising means for applying said force including a pusher surrounded by said sidewall and movable toward and away from said mainplate, said pusher abutting said median portion and further comprising means for limiting the extent of movability of said pusher away from said bottom wall.

14. The switching unit of claim 13, wherein said pusher comprises at least one motion receiving portion extending in a direction away from said bottom wall, and further comprising a housing for said mounting member and actuating means provided in said housing and operative to move said pusher by way of said at least one motion receiving portion in a direction toward said bottom wall.

15. The switching unit of claim 14, wherein said pusher includes a plate which is reciprocable in said mounting member toward and away from said bottom wall and said at least one motion receiving portion includes a protuberance on said plate.

16. The switching unit of claim 13, further comprising an electric signal generator provided on said pusher and having electric terminals extending through passages provided therefor in said mounting member.

17. The switching unit of claim 16, wherein said signal generator comprises a light emitting diode.

18. The switching unit of claim 16, wherein said pusher includes a plate having a first side facing toward and a second side facing away from said mainplate, said signal generator being disposed at the second side of said plate.

19. The switching unit of claim 13, wherein said conductor means comprises strips embedded in said bottom wall and extending outwardly from said mounting member.

20. The switching unit of claim 13, wherein said contact comprises at least one strip embedded into said bottom wall and extending outwardly from said mounting member.

21. The switching unit of claim 12, wherein said bearing portions are fixedly secured to said conductor means.

* * * * *